US011365608B2

(12) United States Patent
Zheng et al.

(10) Patent No.: US 11,365,608 B2
(45) Date of Patent: Jun. 21, 2022

(54) METHOD OF OPERATING A TUBULAR STRING ASSEMBLY WITHIN A WELLBORE

(71) Applicants: Haining Zheng, Chatham, NJ (US); Lei Wang, The Woodlands, TX (US); Michael W. Walker, The Woodlands, TX (US)

(72) Inventors: Haining Zheng, Chatham, NJ (US); Lei Wang, The Woodlands, TX (US); Michael W. Walker, The Woodlands, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 922 days.

(21) Appl. No.: 16/148,684

(22) Filed: Oct. 1, 2018

(65) Prior Publication Data

US 2019/0178059 A1 Jun. 13, 2019

Related U.S. Application Data

(60) Provisional application No. 62/598,196, filed on Dec. 13, 2017.

(51) Int. Cl.
*E21B 41/00* (2006.01)
*E21B 47/00* (2012.01)
(Continued)

(52) U.S. Cl.
CPC ..... *E21B 41/0092* (2013.01); *E21B 44/00* (2013.01); *E21B 47/00* (2013.01); *E21B 21/062* (2013.01); *E21B 21/08* (2013.01)

(58) Field of Classification Search
None
See application file for complete search history.

(56) References Cited

U.S. PATENT DOCUMENTS 3,811,510 A * 5/1974 Rogers ..... E21B 43/10 166/61
9,341,054 B2 * 5/2016 Harman ..... E21B 47/135
(Continued)

OTHER PUBLICATIONS

Borjas et al. (2017) "A Synchronized Rigsite-to-Office Approach to the Management of Automated Torque and Drag Date," presented at SPE/IADC Drilling Conference, The Hague, Netherlands, Mar. 14-16, 2017 (SPE/IADC-184691-MS), pp. 1-10.
(Continued)

*Primary Examiner* — John J Figueroa
(74) *Attorney, Agent, or Firm* — ExxonMobil Upstream Research Company—Law Department

(57) ABSTRACT

A method of moving a string assembly within a wellbore is disclosed. In some embodiments, the method comprises moving the string assembly within the wellbore; obtaining surface data regarding at least one parameter associated with moving the string assembly within the wellbore over a range of depths; modeling the at least one parameter over the range of depths for a plurality of assumed friction factors to obtain modeled data for each assumed friction factor; calculating a derivative of the surface data over the range of depths; calculating a derivative of the modeled data over the range of depths; comparing the derivative of the surface data to the derivative of the modeled data; determining one or more local friction factors for the range of depths based on the comparison; and adjusting at least one string assembly operating parameter based on the one or more local friction factors.

19 Claims, 4 Drawing Sheets

(51) Int. Cl.

| | |
|---|---|
| ***E21B 44/00*** | (2006.01) |
| ***E21B 21/08*** | (2006.01) |
| ***E21B 21/06*** | (2006.01) |

(56) References Cited

U.S. PATENT DOCUMENTS

| | | | | |
|---|---|---|---|---|
| 2004/0040707 | A1* | 3/2004 | Dusterhoft | E21B 43/14 166/279 |
| 2017/0152718 | A1* | 6/2017 | Zhang | E21B 23/01 |
| 2018/0058187 | A1* | 3/2018 | Magnuson | E21B 19/20 |
| 2019/0128114 | A1* | 5/2019 | Bryant | E21B 47/06 |

OTHER PUBLICATIONS

Kucs et al. (2008) "Automated Real-Time Hookload and Torque Monitoring," presented at IADC/SPE Drilling Conference, Orlando, Florida, Mar. 4-6, 2008 (IADC/SPE 112565), pp. 1-14.

* cited by examiner

METHOD OF OPERATING A TUBULAR STRING ASSEMBLY WITHIN A WELLBORE

CROSS REFERENCE TO RELATED APPLICATIONS

This application claims the benefit of U.S. Provisional Application Ser. No. 62/598,196, titled "Method of Running a String Assembly into a Wellbore Incorporating Calculation of Local Friction Factors," filed Dec. 13, 2017, the disclosure of which is incorporated herein by reference in its entirety.

FIELD OF DISCLOSURE

The present disclosure relates generally to the field of oil and gas well operations. More particularly, the present disclosure relates to a method of moving a tubular string assembly within a wellbore, more particularly or commonly to running a tubular string assembly into a wellbore wherein at least one operating parameter is adjusted based on a local friction factor calculated from surface data.

DESCRIPTION OF RELATED ART

This section is intended to introduce various aspects of the art that may be associated with the present disclosure. This discussion aims to provide a framework to facilitate a better understanding of particular aspects of the present disclosure. Accordingly, it should be understood that this section should be read in this light, and not necessarily as an admission of prior art.

In the oil and gas industry, many well operations (e.g., drilling, tripping, casing, completion, remediation, etc.) are often affected by torque and drag (T&D) forces resulting from various conditions under which equipment operates within a wellbore. "Torque" in general refers to the force experienced by the equipment (such as a drilling or casing string assembly) opposite to the rotation relative to the earth, while "drag" refers to the force experienced by the equipment opposite to the linear motion relative to the earth. T&D forces are manifestations of friction that resist the movement of the equipment and may cause problems such as premature wear, buckling, failure, or the inability to achieve target depths.

Several monitoring tools and T&D models exist that attempt to predict or estimate T&D forces during well operations. Some approaches rely on calculation of a "friction factor," which is a dimensionless coefficient that is intended to represent the overall friction between the equipment and the wellbore environment. However, a limitation of currently available modeling tools is that they are only able to estimate the average friction factors along the overall length of the wellbore, not "local" friction factors at specific locations.

SUMMARY

The present disclosure provides a method for running a string assembly within a wellbore. In some embodiments, the method comprises running the string assembly within the wellbore; obtaining surface data regarding at least one parameter associated with running the string assembly within the wellbore over a range of depths; modeling the at least one parameter over the range of depths for a plurality of assumed friction factors to obtain modeled data for each assumed friction factor; calculating a derivative of the surface data over the range of depths; calculating a derivative of the modeled data over the range of depths; comparing the derivative of the surface data to the derivative of the modeled data; determining one or more local friction factors for the range of depths based on the comparison; and adjusting at least one string assembly operating parameter based on the one or more local friction factors.

In some embodiments, determining one or more local friction factors the range of depths may comprise adopting, as the local friction factor for each depth of the range of depths, the friction factor corresponding to the modeled data with a derivative value that matches a derivative value of the surface data at that depth. In yet other embodiments, the method may comprise plotting the surface data and plotting the modeled data over the range of depths, and comparing the plot of the derivative of the surface data with the plot of the derivative of the modeled data. In those embodiments, determining one or more local friction factors for the range of depths may comprise adopting, as the local friction factor for each depth of the range of depths, the friction factor corresponding to the modeled data with a derivative value that matches a derivative value of the surface data at that depth based on the comparison of the plot of the derivative of the surface data with the plot of the derivative of the modeled data. The determination may comprise adopting, as the local friction factor for each depth of the range of depths, a friction factor extrapolated from the modeled data with derivative values closest to a derivative value of the surface data at that depth. The methods also include operating the string assembly within the wellbore by moving (running) the string assembly at least axially within the wellbore using the adjusted operating parameter. Such operation may include moving a tubular in conjunction with a wellbore operation related to using or constructing the wellbore, and may be in conjunction with other movements, such as rotational or applying loads such as applying tension or compression.

In other embodiments, the at least one parameter may be hook load or surface torque. The string assembly may be, for example, a drilling string or a casing string. In yet other embodiments, the at least one parameter may be modeled over the range of depths using a torque and drag model.

The foregoing has broadly outlined the features of the present disclosure so that the detailed description that follows may be better understood. Additional features will also be described herein.

BRIEF DESCRIPTION OF THE DRAWINGS

These and other features, aspects and advantages of the disclosure will become apparent from the following description, appending claims and the accompanying drawings, which are briefly described below.

Figure 1B:
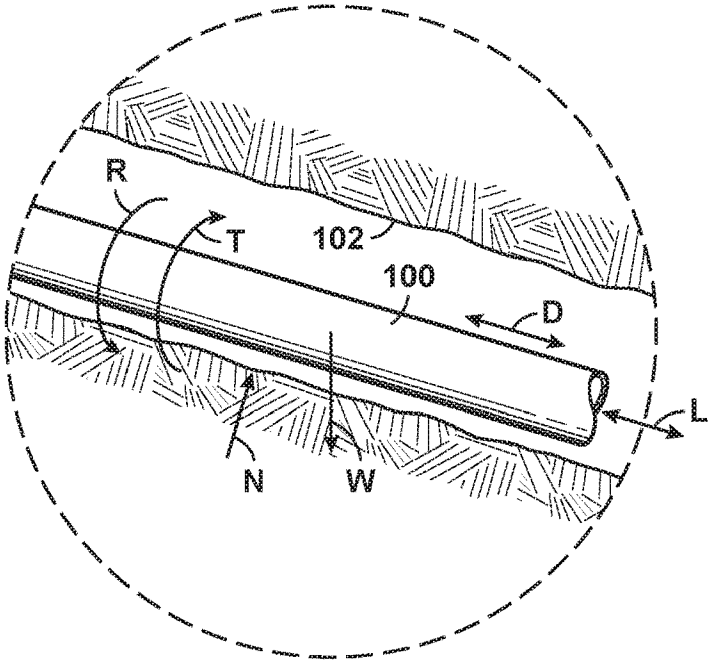
FIG. 1B is a close-up of a portion of the wellbore illustrated in FIG. 1A.

It should be noted that the figures are merely examples and no limitations on the scope of the present disclosure are intended thereby. Further, the figures are generally not drawn to scale, but are drafted for purposes of convenience and clarity in illustrating various aspects of the disclosure.

DETAILED DESCRIPTION

To promote an understanding of the principles of the disclosure, reference will now be made to the features illustrated in the drawings and no limitation of the scope of the disclosure is thereby intended by specific language. Any alterations and further modifications, and any further applications of the principles of the disclosure as described herein are contemplated as would normally occur to one skilled in the art to which the disclosure relates. For the sake of clarity, some features not relevant to the present disclosure may not be shown in the drawings.

At the outset, for ease of reference, certain terms used in this application and their meanings as used in this context are set forth below. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As one of ordinary skill would appreciate, different persons may refer to the same feature or component by different names. This document does not intend to distinguish between components or features that differ in name only. Further, in the following description and in the claims, the terms "including" and "comprising" are used in an open-ended fashion, and thus, should be interpreted to mean "including, but not limited to."

The figures are not necessarily to scale. Certain features and components herein may be shown exaggerated in scale or in schematic form and some details of conventional elements may not be shown in the interest of clarity and conciseness. When referring to the figures described herein, the same reference numerals may be referenced in multiple figures for the sake of simplicity.

The term "friction factor" or "FF" as used herein refers to a dimensionless quantity that represents the friction between equipment (e.g., drilling or completion equipment such as drill string, casing, liner, sand screen) and the wellbore. The friction factor may depend on many factors such as the characteristics of the drilling fluid, concentration of cuttings, downhole patterns, the geometry and orientation of the borehole, whether the equipment is moving within an open hole (i.e., rock and formation) or cased hole (i.e., steel), etc. Qualitatively, a lower friction factor may indicate less friction and better borehole quality. Conversely, a higher friction factor may suggest higher friction, although it does not alone provide sufficient information regarding the type of issues that might be affecting borehole quality.

The term "local friction factor" as used herein refers to the friction factor at a specific location or over a relatively small section of the wellbore. The local friction factor may indicate the occurrence of factors creating higher friction within the wellbore, unlike the conventional friction factor which only provides an average or aggregated measure of friction effects for the entire portion of the wellbore above the point of interest.

The term "operating" the string assembly may refer to running, positioning, or merely moving a tubular string assembly axially, rotationally, pulling tension to a portion of the string, applying compression to a portion of the string, and/or combinations thereof, as part of an activity related to using, remediating, creating the wellbore, and conducting an operation on the subterranean formation surrounding the wellbore, such as but no limited to a drilling operation, running drill pipe, running casing, a coil tubing operation, tripping a tubular string into or out of a wellbore, positioning downhole tools, conducting a well completion operation, and combinations thereof.

The term "running" broadly means moving or displacing a tubular conduit or member or string thereof axially within a wellbore, and may refer to removing the string from the wellbore, inserting the string into the wellbore, or merely positioning or repositioning a string axially within a wellbore, including axial displacements from merely a few inches, up to and including the length of the wellbore.

The term "axially" refers to a direction parallel with the long axis along the length or centerline of a wellbore from surface to bottomhole, and portions thereof, including straight portions, curved portions, vertical portions, helical portions, and lateral, angular, or horizontal portions.

As used herein, the term "hook load" refers to the tension force experienced by the hook or part of a rig from which drilling or completion equipment typically hangs. The hook load is generally equal to the buoyant weight of the equipment being lowered or pulled from a wellbore (i.e., drill string, liner, casing, etc.) minus friction forces.

As used herein, the term "pick up" or "PU" refers to the movement of equipment assembly out of the wellbore. During pick up, the hook load is normally higher than the buoyant weight of the assembly due to the friction drag.

As used herein, the term "rotation off bottom" or "ROT" refers to the rotation of a string assembly within the wellbore, while keeping a distance from the bottom of the borehole. During rotation off bottom, all the friction contributes to rotation torque.

As used herein, the term "slack off" or "SO" refers to moving a string assembly into the wellbore. Slack off may be considered to be essentially the opposite of pick up.

As used herein, the term "surface torque" refers to the torque recorded at the rig located on the surface from which equipment is suspended and deployed into the wellbore.

The articles "the," "a" and "an" are not necessarily limited to mean only one, but rather are inclusive and open ended to include, optionally, multiple such elements.

As used herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numeral ranges provided. Accordingly, these terms should be interpreted as indicating that insubstantial or inconsequential modifications or alterations of the subject matter described and are considered to be within the scope of the disclosure.

"Exemplary" is used exclusively herein to mean "serving as an example, instance, or illustration." Any embodiment or aspect described herein as "exemplary" is not to be construed as preferred or advantageous over other embodiments.

Aspects described herein provide a method for running a string assembly within a wellbore. In some embodiments, the method comprises running the string assembly within the wellbore; obtaining surface data regarding at least one parameter associated with running the string assembly within the wellbore over a range of depths; modeling the at least one parameter over the range of depths for a plurality of assumed friction factors to obtain modeled data for each assumed friction factor; calculating a derivative of the surface data over the range of depths; calculating a derivative of the modeled data over the range of depths; comparing the derivative of the surface data to the derivative of the modeled data; determining one or more local friction factors for the range of depths based on the comparison; and adjusting at least one string assembly operating parameter based on the one or more local friction factors.

In some embodiments, determining one or more local friction factors for the range of depths may comprise adopting, as the local friction factor for each depth of the range of depths, the friction factor corresponding to the modeled data with a derivative value that matches a derivative value of the surface data at that depth. In yet other embodiments, the method may comprise plotting the surface data and plotting the modeled data over the range of depths, and comparing the derivative of the surface data to the derivative of the modeled data may comprise comparing the plot of the derivative of the surface data with the plot of the derivative of the modeled data. In those embodiments, determining one or more local friction factors for the range of depths may comprise adopting, as the local friction factor for each depth of the range of depths, the friction factor corresponding to the modeled data with a derivative value that matches a derivative value of the surface data at that depth based on the comparison of the plot of the derivative of the surface data with the plot of the derivative of the modeled data. Alternatively, the determination may comprise adopting, as the local friction factor for each depth of the range of depths, a friction factor extrapolated from the modeled data with derivative values closest to a derivative value of the surface data at that depth based on the comparison of the plot of the derivative of the surface data with the plot of the derivative of the modeled data.

In other embodiments, the at least one parameter may be hook load or surface torque. The string assembly may be, for example, a drilling string or a casing string. In yet other embodiments, the at least one parameter may be modeled over the range of depths using a torque and drag model.

Figure 1A:
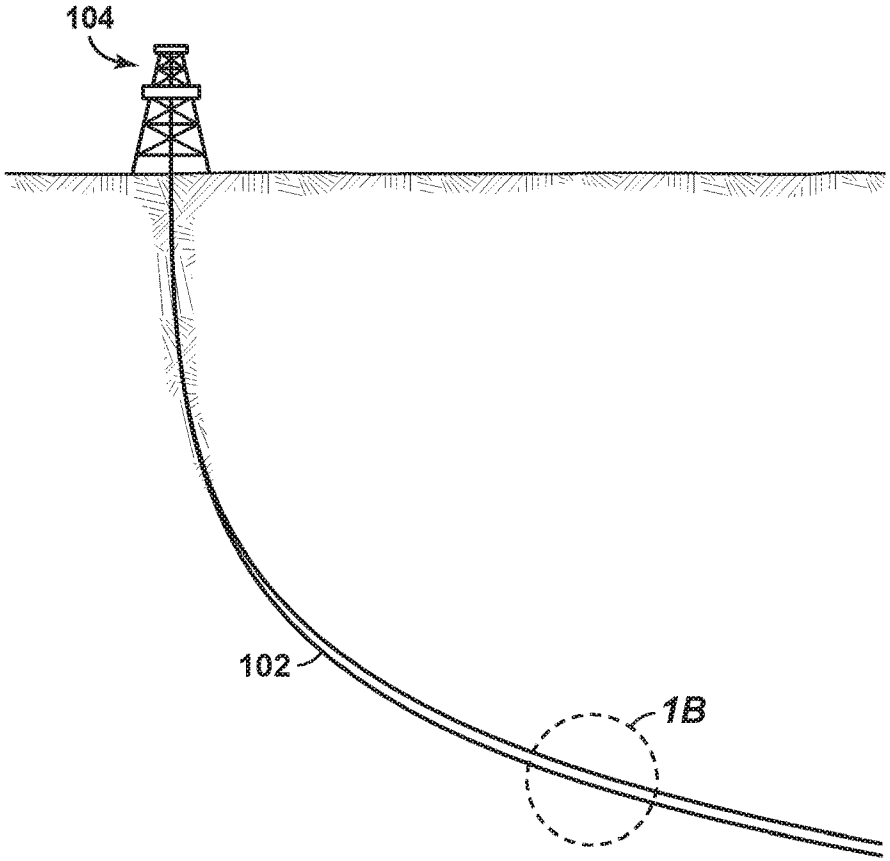
FIG. 1A is an exemplary diagram of a section of wellbore and string assembly therein.

Referring to FIG. 1A, a diagram of a non-vertical well is shown. At the surface of the well there may be a rig 104 used to support, deploy and/or control equipment, such as drilling or completion equipment, within wellbore 102. It should be understood that the present disclosure is applicable to any well orientation and cross-sectional geometry, and the well configuration illustrated in FIG. 1A is provided as an example only. A close-up of an inclined section of wellbore 102 provided in FIG. 1B shows a section of a string assembly 100 (which could be, for example, a section of a drilling string or a casing string) within the section of wellbore 102. In this example, string assembly 100 is illustrated as a tubular piece of equipment that may be formed by one or multiple pipe sections, but it should be understood that other types of equipment intended for deployment within a wellbore are contemplated herein. In the close-up of FIG. 1B, string assembly 100 rests on the bare bottom surface of wellbore 102.

As illustrated in FIG. 1B, the string assembly 100 may experience a weight force W due to gravity, a side force N (normal to the wellbore) due to contact with the wellbore 102 or materials deposited within, a rotation force R induced by the action of topside equipment, and a linear force L (which may be tensile or compressive) resulting from the topside equipment pushing or pulling the string assembly, as the case may be, within wellbore 102. The string assembly 100 may also experience two friction-related forces: a torque force T opposite the rotation force R, and an axial drag D opposite the direction of force L. The combination of torque T and drag D, also referred to as "T&D", is a direct result of friction between the section of string assembly 100, on one hand, and the material with which the string assembly 100 is in contact, which in this case is the bottom interior surface of the wellbore 102 but may be, for example, drilling fluid (also known as "mud") or casing.

An accurate estimation of the friction factor is a crucial aspect of predicting T&D forces during well operations to optimize running a string assembly in and out of a wellbore, for example, during drilling, tripping, casing, or completion operations, and avoid problems such as the equipment becoming stuck. Some computational T&D models exist that rely on surface data, such as hook load or surface torque measurements, to estimate overall friction factors by comparison to modeled or predicted behavior for various friction factors. Examples of T&D modeling software are described in Ricardo Borjas et al., "A Synchronized Rigsite-to-Office Approach to the Management of Automated Torque and Drag Date" presented at SPE/IADC Drilling Conference, The Hague, Netherlands, 14-16 Mar. 2017 (SPE/IADC-184691-MS), and Richard Kucs et al., "Automated Real-Time Hookload and Torque Monitoring" presented at IADC/SPE Drilling Conference, Orlando, Fla., 4-6 Mar. 2008 (IADC/SPE 112565).

Figure 2:
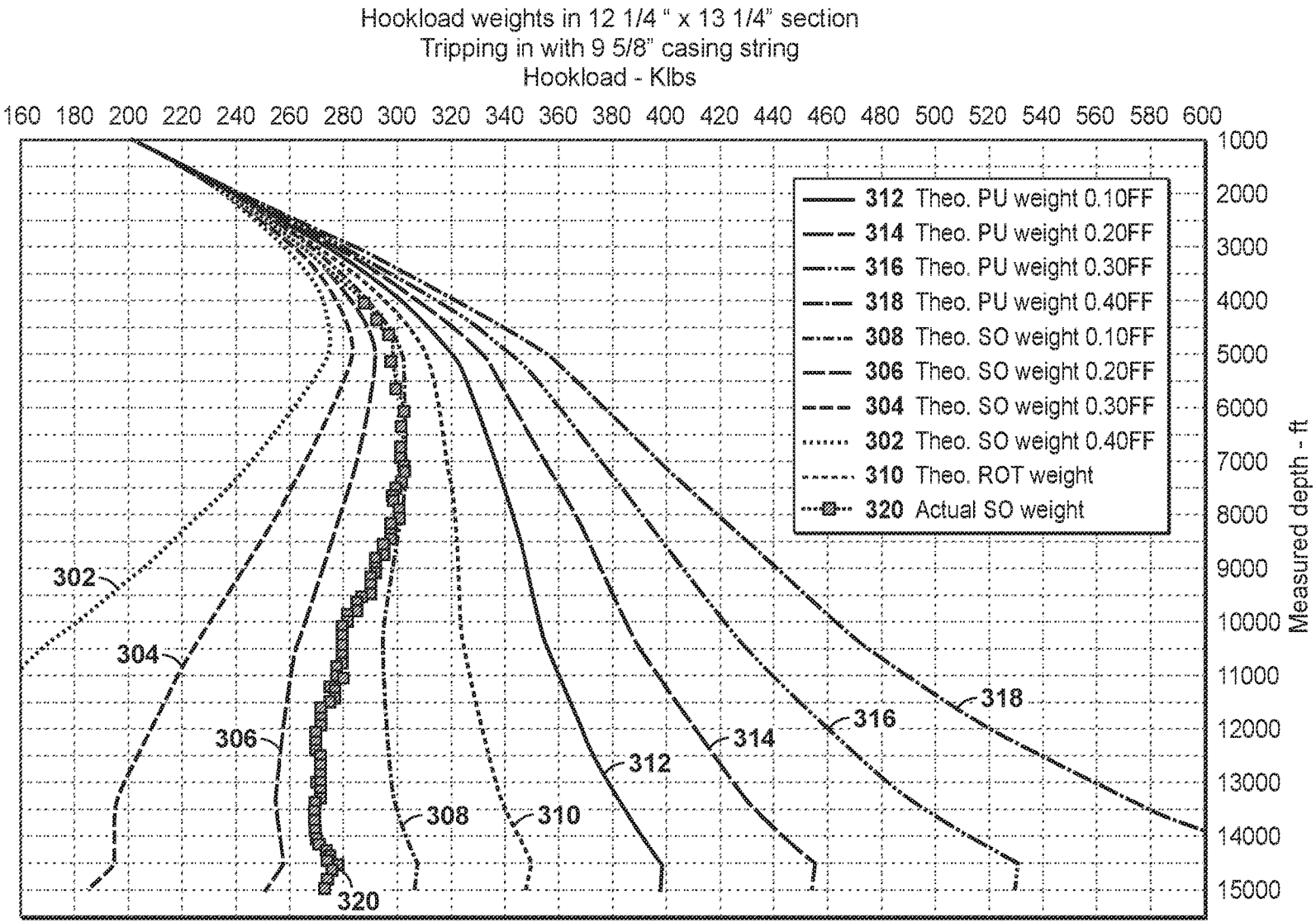
FIG. 2 is an exemplary hook load plot showing modeled hook load for various friction factors and SO, ROT and PU conditions, as well as observed hook load.

For example, referring to FIG. 2, a conventional hook load plot generated by T&D modeling software is shown. In this plot, observed hook load data is overlapped with predicted data modeled by the T&D software. The plot shows hook load (horizontal axis) at depths (vertical axis) between 1,000 and 15,500 ft. On the far left side of the plot, curves 302, 304, 306, and 308 correspond to modeled hook load during slack off (SO) operations assuming the average friction factor along the wellbore is 0.4, 0.3, 0.2, and 0.1, respectively. On the far right side of the plot, curves 312, 314, 316, and 318 represent modeled hook load during pick up (PU) operations assuming the average friction factor along the wellbore is 0.1, 0.2, 0.3 and 0.4, respectively. Curve 310 corresponds to the modeled hook load during ROT conditions.

Using a plot such as the one in FIG. 2, one existing approach for estimating the average friction factor along a wellbore relies on overlapping the observed hook load data (320) with the modeled curves. Curve 320 corresponds to actual hook load data measured during SO for the plotted depth range. As can be appreciated from FIG. 2, the actual hook load data closely tracks the modeled 0.1 FF curve 308 at shallow depths, but begins to deviate from the 0.1 FF curve 308 towards the 0.2 FF curve 306 at around 8,500 ft. in depth. The actual hook load data line 320 continues to approach the 0.2 FF curve 306 as depth increases. Using this points-overlapped-with-curves approach, it may be inferred that the average friction factor along the wellbore increases at depth increases, and falls somewhere between 0.1 and 0.2 or higher along this plotted depth range for this particular well. The same approach may be followed using conventional T&D software to plot other observed surface data, such as surface torque, against predicted data generated by a T&D model for a range of measured depths and operating conditions (i.e., SO, PU, ROT).

But it should be noted that the friction factor contemplated in plots generated by existing T&D models represents the average friction over the entire length of the portion of the wellbore located above the point of interest in the plot. For example, according to curve 320, at a depth of 6,500 ft., an observed hook load of 300 klbs. during SO indicates that the average friction factor for the section of wellbore spanning between 0 and 6,500 ft. in depth is about 0.10. This is not necessarily the friction factor at 6,500 ft., but the aggregate friction factor over the length of the wellbore between the surface and 6,500 ft. in depth. As another example, from the plot in FIG. 2, one may infer that the average friction factor along the entire section of wellbore between 0 and 10,000 ft. is closer to 0.15. And the average friction factor for the entire section of wellbore between 0 and 14,000 ft. is around 0.17. Whether and how the actual friction factor at specific points within this depth range may change or fluctuate is not discernible from this plot. In other words, the need exists for tools that can provide an estimate of the true "local" friction factors at specific locations within a wellbore.

According to some aspects of the present disclosure, a method of running a string assembly within a wellbore and adjusting operating parameters based on local friction factors is described. In particular, local friction factors at specific depths or small ranges of depths may be determined based on surface data such as hook load or surface torque. For example, in some embodiments, a slope-based indicator may be calculated as the derivative of the function of actual hook load or surface torque and measured depth (MD):

$$\text{Slope} = \frac{d(hookload)}{d(MD)} \text{ or Slope} = \frac{d(\text{surface torque})}{d(MD)} \qquad \text{(Eq. 1)}$$

The above equation is based on the assumption that the derivative (i.e., slope) of the hook load vs. MD curve or of the surface torque vs. MD curve at a given depth is directly correlated to the local friction factor corresponding to such depth. This local friction factor may be used, for example, as a surveillance factor to monitor current wellbore conditions during well operations to mitigate factors creating high friction within the wellbore.

Figure 3B:
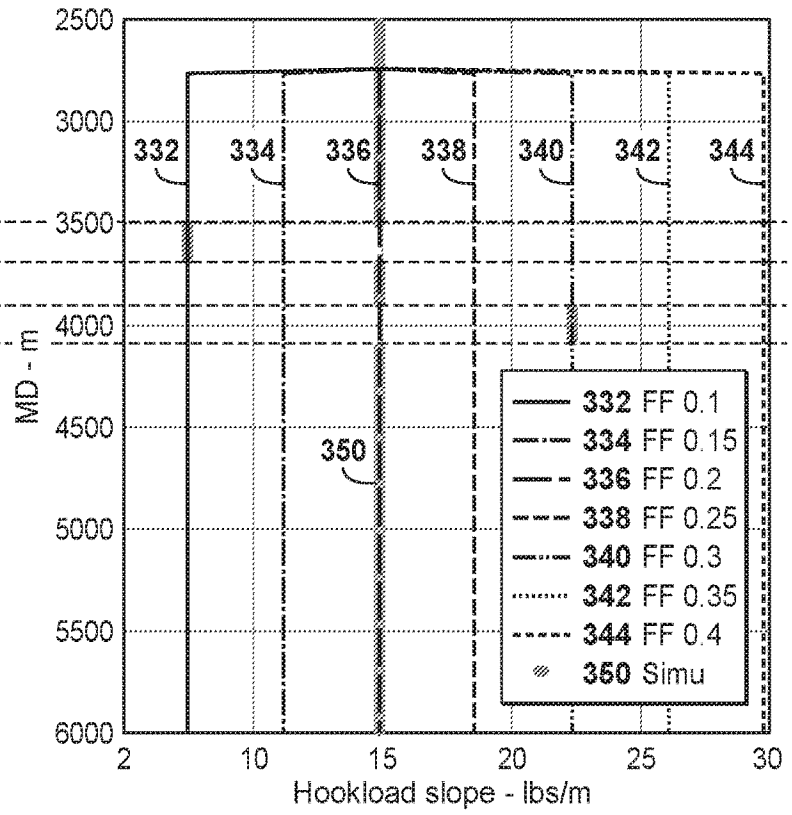
FIG. 3B is an exemplary plot of the slope of the modeled and surface hook load data in FIG. 3A.
Figure 3A:
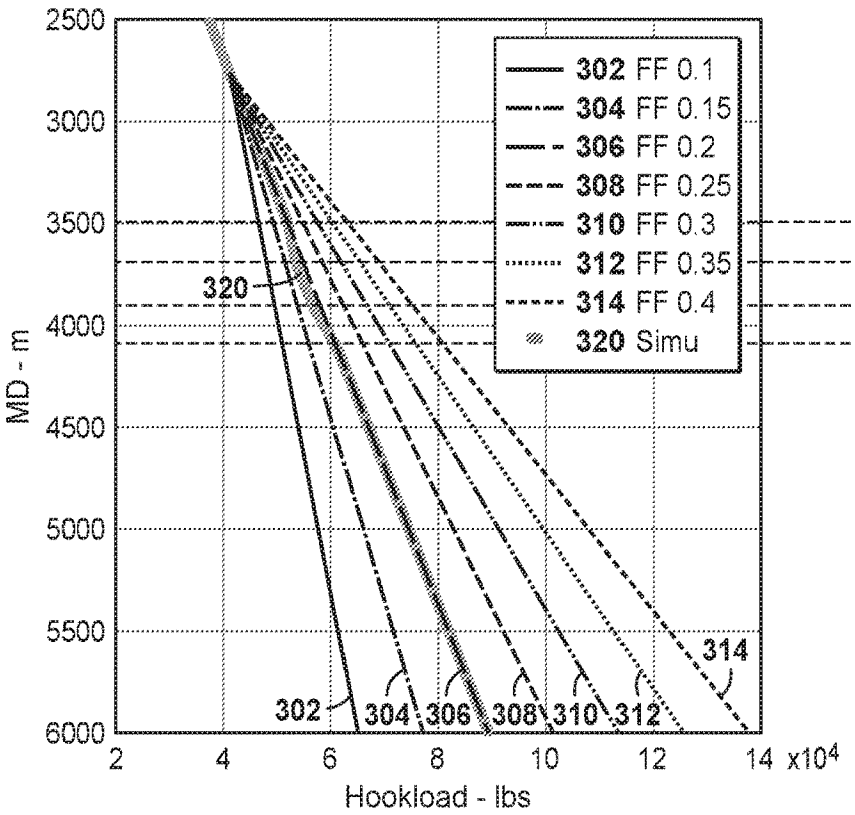
FIG. 3A is an exemplary plot of modeled and surface hook load data at PU conditions.

Referring to FIG. 3A, an exemplary set of actual hook load data at PU conditions is plotted in the x-axis against a measured depth (MD) between 2,500 and 6,000 meters in the y-axis. The actual hook load data is overlapped with modeled hook load curves for the same depth range. While in this case the actual PU hook load data was obtained from a simulation, this was done for purposes of simplifying the illustration only and it should be understood that the described method is equally applicable to actual hook load data obtained from direct measurements in the field, which as explained below, may be more scattered due to noise. In FIG. 3A, lines 302, 304, 306, 308, 310, 312, and 314 correspond to modeled hook load data based on friction factors of 0.1, 0.15, 0.2, 0.25, 0.3, 0.35, and 0.4, respectively. The actual PU hook load data is shown by shaded line 320 and can be seen closely matching the 0.2 FF curve except for measured depths between 3,500 and 4,100 m.

According to some aspects of the described method, the derivative of the actual PU hook load and the modeled hook load curves shown in FIG. 3A, may be calculated. Specifically, the following slope values (in lbs/m) may be calculated for each modeled hook load curve in FIG. 3A using Eq. 1:

TABLE 1

| Curve (FIG. 3A) | Friction Factor | Slope Value | Slope Line (FIG. 3B) |
|---|---|---|---|
| 302 | 0.1 | 7.5 | 332 |
| 304 | 0.15 | 11.25 | 334 |
| 306 | 0.2 | 15 | 336 |
| 308 | 0.25 | 18.75 | 338 |
| 310 | 0.3 | 22.5 | 340 |
| 312 | 0.35 | 26 | 342 |
| 314 | 0.4 | 30 | 344 |

The resulting hook load "slope" is shown in the x-axis in FIG. 3B, against the measured depth (MD) in the y-axis. The slope of the modeled curves 302, 304, 306, 308, 310, 312, and 314 from FIG. 3A, corresponds to lines 332, 334, 336, 338, 340, 342, and 344 in FIG. 3B, respectively. Because each modeled hook load curve corresponding to different friction factors in FIG. 3A is a straight line along the range of depths, the corresponding slopes in FIG. 3B are constant in this instance. In practice, however, the slope may vary over depth depending on the rate of change in the modeled hook load (i.e., the trajectory of the modeled hook load curves if plotted) and may not necessarily be constant as in the example in FIG. 3B. It should further be noted that the range of depths for which a derivative may be calculated may depend on the noise level of the recorded data and the slope may vary from one joint of the string assembly (about 10 meters) to another, or from one stand of the string assembly (about 30 meters) to another.

The slope (i.e., derivative) of the actual PU hook load data 320 in FIG. 3A, may also be calculated using Eq. 1. This is shown by shaded line 350 in FIG. 3B. As can be appreciated from FIG. 3B, the slope of the actual PU hook load line 350 is the same as the slope of the modeled 0.2 FF curve for depths between 2,500 and 3,500 meters (15 lbs/m), and between 4,100 and 6,000 meters (15 lbs/m). FIG. 3B also shows that the slope is the same (15 lbs/m) as the slope of the 0.2 FF curve at depths between 3,700 and 3,900 meters.

For depths between 3,500 and 3,700 meters, however, the slope of the actual PU hook load line matches the slope of the modeled curve corresponding to a friction factor of 0.1, and for depths between 3,900 and 4,100 meters, the slope of the actual PU hook line matches the slope of the modeled curve corresponding to a friction factor of 0.3. As such, it can be determined that the local friction factors at those sections of wellbore are 0.1 and 0.3, respectively. While this determination may be made by visual inspection of a slope plot such as FIG. 3B, it should be understood that plotting the slope is not required to practice the techniques described herein, and determining a local friction factor may be implemented according to the present disclosure by simply calculating the slope (i.e., derivative) of the observed hook load using to Eq. 1 and numerically comparing the value to the derivative value of modeled hook load behavior.

The advantages of the described method may be appreciated when considering that a slope comparison between actual data and modeled data may be difficult or impossible to perform directly or using conventional plots such as the example in FIG. 2, among other reasons because the surface data typically does not overlap with modeled curves. For example, it would be difficult or impossible to discern from FIG. 3A, that the actual hook load data for the wellbore section between 3,500 and 3,700 meters is changing at the same rate as the modeled data corresponding to a 0.1 friction factor, and that the actual hook load data for the wellbore section between 3,900 and 4,100 meters is changing at the same rate as the modeled data corresponding to a 0.3 friction factor. But the derivative approach described herein makes it possible to identify regions at which the rate of change in the observed hook load matches or approximates the modeled hook load data for a given friction factor and, as a result, identify the local friction factor at such depths.

Persons of skill in the art will also recognize that, while the above example involves modeled hook load curves having constant slopes over the plotted depth range, the described local friction factor calculation is applicable to any rate of change and any data curve trajectory. The data in FIGS. 3A and 3B was generated assuming an L-shaped well with a horizontal section, but the techniques described herein are applicable to other well profiles such as an S-shaped wells. Furthermore, while the slope of the actual PU hook load data in FIG. 3B overlaps (i.e., is the same as) the slope of modeled hook load curves, it may be possible that the slope of the observed hook load data may fall somewhere in between slopes of modeled data. In such instances, one would estimate the applicable local friction factor depending on where the slope for the actual PU hook load data falls using, for example, extrapolation. Alternatively, a finer series of friction factors may be used (e.g., using a step size of 0.02 FF instead of 0.05 FF as in the examples provided herein) to model hook load until the slope of actual PU hook load data matches the slopes of modeled data.

It should also be noted that the described method is applicable to a variety of surface measurements and modeled data, including hook load and surface torque during ROT, PU and/or SO conditions, over the entire range of possible measured depths. For instance, in yet other embodiments of the present disclosure, the method of running a string assembly within a wellbore may be implemented based on surface torque data. With reference to FIG. 4A, an exemplary plot similar to FIG. 3A, is provided but showing in the x-axis a set of actual surface torque data during ROT conditions and modeled surface torque data for a range of assumed friction factors. The data is plotted against a range measured depths (MD) between 3,000 and 6,000 meters in the y-axis. As with FIG. 3A, the actual ROT surface torque data illustrated in FIG. 4A, is simulated for simplicity but could be real field data. Also, while ROT conditions are assumed in this example, the methodology is applicable to other surface torque data including data obtained during PU and SO conditions.

In FIG. 4A, lines 402, 404, 406, 408, 410, 412, and 414 represent modeled surface torque curves corresponding to friction factors of 0.1, 0.15, 0.2, 0.25, 0.3, 0.35, and 0.4, respectively. Shaded line 420 represents the actual ROT surface torque. Using the described method according to some aspects disclosed herein, the slope associated with each of the actual and modeled surface torque data may be calculated using Eq. 1. Specifically, the following slope values (in ft-lbs/m) may be calculated for each modeled surface torque curve in FIG. 4A:

TABLE 2

| Curve (FIG. 4A) | Friction Factor | Slope Value | Slope Line (FIG. 4B) |
|---|---|---|---|
| 402 | 0.1 | 1.88 | 432 |
| 404 | 0.15 | 2.80 | 434 |

TABLE 2-continued

| Curve (FIG. 4A) | Friction Factor | Slope Value | Slope Line (FIG. 4B) |
|---|---|---|---|
| 406 | 0.2 | 3.75 | 436 |
| 408 | 0.25 | 4.72 | 438 |
| 410 | 0.3 | 5.66 | 440 |
| 412 | 0.35 | 6.58 | 442 |
| 414 | 0.4 | 7.50 | 444 |

Figure 4B:
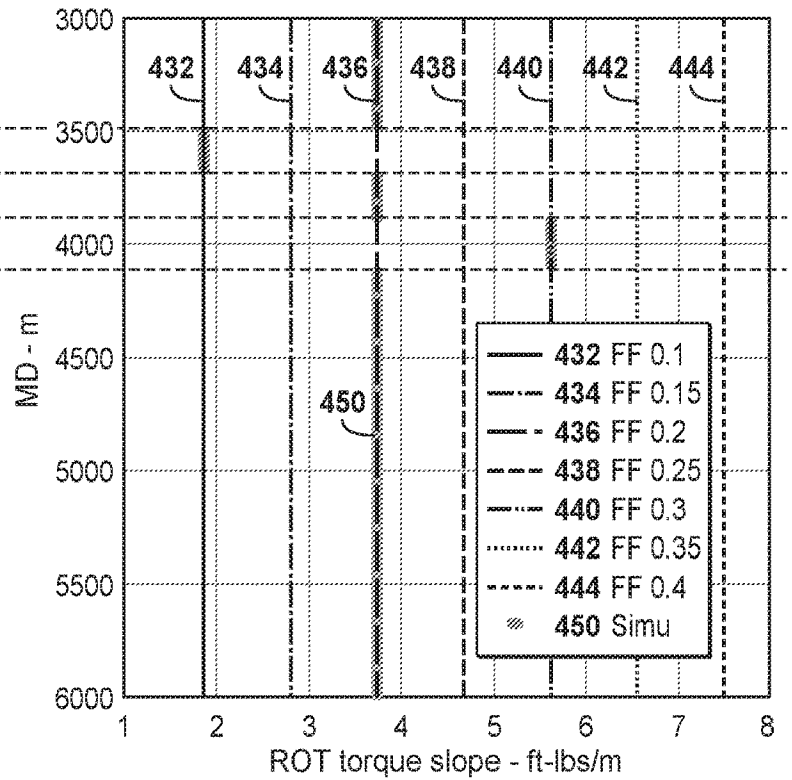
FIG. 4B is an exemplary plot of the slope of the modeled and surface torque data in FIG. 4A.
Figure 4A:
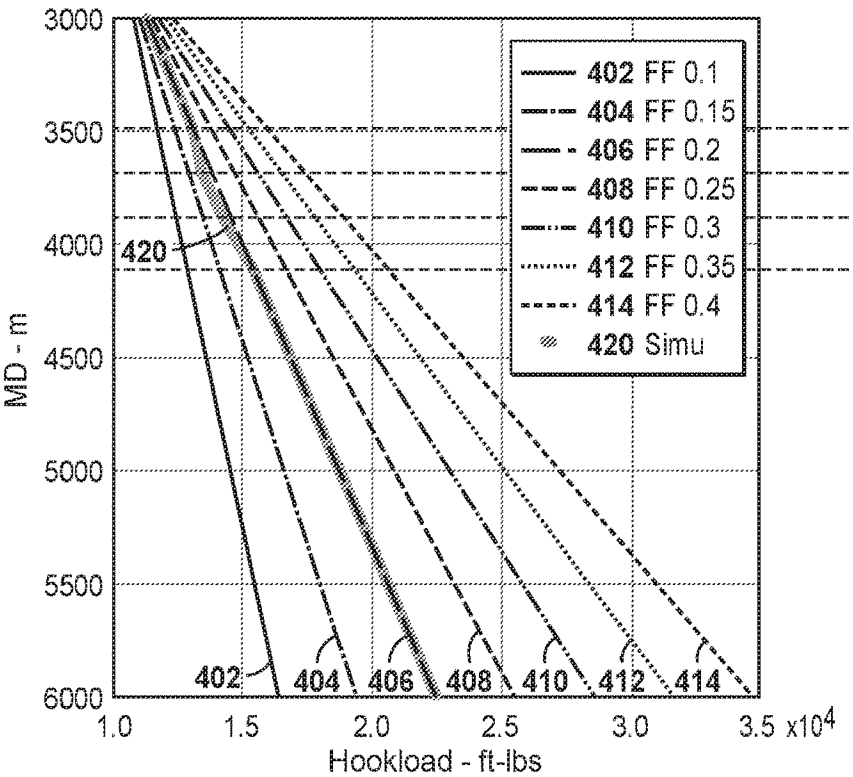
FIG. 4A is an exemplary plot of modeled and surface torque at ROT conditions.

The slope information is illustrated in FIG. 4B, where lines 432, 434, 436, 438, 440, 442, and 444 correspond to the slope of the modeled surface torque curves 402, 404, 406, 408, 410, 412, and 414 shown in FIG. 4A. As with FIG. 3B, because all modeled surface torque curves are straight lines in FIG. 4A, the corresponding slopes in FIG. 4B are constant. But it should be understood that the slope may vary over depth.

FIG. 4B also shows the slope of the actual ROT surface torque data in shaded line 450. As can be appreciated, the slope of the actual ROT surface torque data is the same (about 3.75 ft-lbs/m) as the slope of the modeled surface torque curve corresponding to a friction factor of 0.2 for the entire MD range except between 3,500 and 3,700 meters and between 3,900 and 4,100 meters. It can therefore be determined that the local friction factor at those locations is 0.2.

In addition, for depths between 3,500 and 3,700 meters, the slope of the actual ROT surface torque data matches the slope of the modeled curve for a friction factor of 0.1 (about 1.88 ft-lbs/m). For depths between 3,900 and 4,100 meters, the slope of the actual ROT surface torque data matches the slope of the modeled curve for a friction factor of 0.3 (about 5.66 ft-lbs/m). As such, it can be determined that the local friction factors at those ranges of measured depths are 0.1 and 0.3, respectively. It should be understood that, while in this case the slope of the actual ROT surface torque data matched perfectly the slope of modeled surface torque curves at certain points, no perfect match is required and a local friction factor may be estimated from the derivative of the observed data even if it falls somewhere in between predicted slope values for modeled scenarios through, for example, extrapolation. Alternatively, a finer series of friction factors may be used (e.g., using a step size of 0.02 FF instead of 0.05 FF as in the examples provided herein) to model surface torque until the slope of actual ROT surface torque data matches the slopes of modeled data. Also, as with the previous example, no actual plotting or visual comparison is necessary and the slope comparison can be made on the derivative values alone.

While the above example was implemented for ROT surface torque data, the described method is applicable to other surface torque measurements such as those obtained during SO or PU with rotation. In addition, while the above example involved modeled surface torque curves with constant slope over the plotted depth range, the described methodology is not limited to a comparison with modeled curves of constant slope.

In some embodiments according to the present disclosure, after estimating the local friction factor for a range of depths, operating parameters may be adjusted to mitigate friction. For example, during drilling operations, if the local friction factor is observed to be relatively high at a certain depth, an operator could adjust the flow rate of drilling fluid or increase circulation time to reduce the local friction factor and improve hole cleaning conditions.

Conversely, if the observed local friction factor is at a healthy level, an operator may decide to reduce circulation time to preserve resources. As another example, during casing runs, if a high local friction factor is observed at a certain depth that might indicate an increased probability of stuck pipe events, an operator could be alerted to take appropriate action, such as starting circulation with casing running tools or rotate the casing if possible. Or an operator may decide to pull the string assembly out of the wellbore before it gets stuck, and run a wiper trip to clean up cuttings that may be increasing friction. Other operating parameters that may be adjusted or actions that may be taken based on local friction factors include, but are not limited to, adjusting rotary speed, adjusting drilling fluid circulation time, adjusting mud weight, and adding lubricant fluid or beads to the mud.

In some other embodiments, observed surface data such as hook load or surface torque may be scattered and include substantial noise. In those cases, traditional data conditioning and filtering techniques may be applied to remove the unwanted noise before calculating the derivative of the data. For example, a FIR (finite impulse response) low pass filter may be used. In other embodiments, noise may be removed using methods such as median filter, wavelet filter, or moving average.

The described method of running a string assembly according to some aspects of the present disclosure provides an advantage over conventional methodologies for adjusting operating parameters based on aggregate friction factors, and makes it possible to isolate points at which observed surface data matches local behavior predicted for specific friction factors. Whereas previous approaches that rely on points-overlapped-with-curves can only be used to estimate aggregate or "lump-sum" friction factors at different wellbore depths, the methodology described herein can be used to estimate true local friction factors at corresponding wellbore depths.

Disclosed aspects may include any combinations of the methods and systems shown in the following numbered paragraphs. This is not to be considered a complete listing of all possible aspects, as any number of variations can be envisioned from the description above.

It should be understood that the numerous changes, modifications, and alternatives to the preceding disclosure can be made without departing from the scope of the disclosure. The preceding description, therefore, is not meant to limit the scope of the disclosure. Rather, the scope of the disclosure is to be determined only by the appended claims and their equivalents. It is also contemplated that structures and features in the present examples can be altered, rearranged, substituted, deleted, duplicated, combined, or added to each other.

What is claimed is:

1. A method of positioning a string assembly within a wellbore comprising:

moving the string assembly at least axially within the wellbore;

obtaining surface data regarding at least one parameter associated with running the string assembly within the wellbore over a range of depths;

modeling the at least one parameter over the range of depths for a plurality of assumed friction factors to obtain modeled data for each assumed friction factor;

calculating a derivative of the surface data over the range of depths;

calculating a derivative of the modeled data over the range of depths;

comparing the derivative of the surface data to the derivative of the modeled data;

determining one or more local friction factors for the range of depths based on the comparison;

adjusting at least one string assembly operating parameter based on the one or more local friction factors; and operating the string assembly within the wellbore by moving the string assembly at least axially within the wellbore using the adjusted operating parameter.

2. The method of claim 1, wherein the at least one parameter is hook load or surface torque.

3. The method of claim 1, wherein the string assembly comprises a drilling string or a casing string.

4. The method of claim 1, wherein the modeling step is performed using a torque and drag computational model.

5. The method of claim 1, wherein the plurality of assumed friction factors ranges between 0.05 and 0.5.

6. The method of claim 1, further comprising plotting the surface data over the range of depths.

7. The method of claim 1, further comprising plotting the modeled data over the range of depths.

8. The method of claim 1, wherein determining one or more local friction factors for the range of depths comprises adopting, as the local friction factor for each depth of the range of depths, the friction factor corresponding to the modeled data with a derivative value that matches a derivative value of the surface data at that depth.

9. The method of claim 1, wherein determining one or more local friction factors for the range of depths comprises adopting, as the local friction factor for each depth of the range of depths, a friction factor extrapolated from the modeled data with derivative values closest to a derivative value of the surface data at that depth.

10. The method of claim 1, further comprising plotting the derivative of the surface data over the range of depths.

11. The method of claim 10, further comprising plotting the derivative of the modeled data over the range of depths.

12. The method of claim 11, wherein comparing the derivative of the surface data to the derivative of the modeled data comprises comparing the plot of the derivative of the surface data with the plot of the derivative of the modeled data.

13. The method of claim 12, wherein determining one or more local friction factors for the range of depths comprises adopting, as the local friction factor for each depth of the range of depths, the friction factor corresponding to the modeled data with a derivative value that matches a derivative value of the surface data at that depth based on the comparison of the plot of the derivative of the surface data with the plot of the derivative of the modeled data.

14. The method of claim 12, wherein determining one or more local friction factors for the range of depths comprises adopting, as the local friction factor for each depth of the range of depths, a friction factor extrapolated from the modeled data with derivative values closest to a derivative value of the surface data at that depth based on the comparison of the plot of the derivative of the surface data with the plot of the derivative of the modeled data.

15. The method of claim 1, further comprising removing noise from the surface drilling data prior to calculating the derivative.

16. The method of claim 15, wherein the step of removing noise is performed using at least one of the following methods: finite impulse response low pass filter, median filter, wavelet filter, and moving average.

17. The method of claim 1, wherein adjusting at least one string assembly operating parameter comprises at least one of adjusting rotary speed, adjusting flow rate, adjusting drilling fluid circulation time, adjusting drilling fluid weight, adding lubricant fluid to drilling fluid, and adding beads to drilling fluid.

18. The method of claim 1, wherein operating the string assembly within the wellbore by moving the string assembly at least axially within the wellbore using the adjusted operating parameter comprises conducting at least one drilling, moving casing, tripping a tubular string into or out of the wellbore, and positioning a downhole tool within the wellbore.

19. The method of claim 1, wherein operating the string assembly within the wellbore by moving the string assembly at least axially within the wellbore using the adjusted operating parameter comprises at least one of (i) stretching a tubular string axially to determine a stuck point and (ii) moving tubular axially while circulating to prevent sticking of the tubular string.

* * * * *